US005205052A

United States Patent [19]

Kraft et al.

[11] Patent Number: 5,205,052

[45] Date of Patent: Apr. 27, 1993

[54] DRYER GROUP WEB TRANSFER REGION FOR PAPER MAKING MACHINE WITH OPEN DRAW

[75] Inventors: Wilfried Kraft; Hans-Peter Sollinger, both of Heidenheim, Fed. Rep. of Germany

[73] Assignee: J. M. Voith GmbH, Fed. Rep. of Germany

[21] Appl. No.: 825,394

[22] Filed: Jan. 24, 1992

[30] Foreign Application Priority Data

Jan. 24, 1991 [DE] Fed. Rep. of Germany ... 9100762[U]
Jan. 17, 1992 [DE] Fed. Rep. of Germany ... 4201107[U]

[51] Int. Cl.[5] ..... F26B 13/08
[52] U.S. Cl. ..... 34/114; 34/116
[58] Field of Search ..... 34/113, 114, 115, 116, 34/117

[56] References Cited

U.S. PATENT DOCUMENTS 5,065,529 11/1991 Skaugen et al. ..... 34/120

*Primary Examiner*—Henry Bennett
*Attorney, Agent, or Firm*—Ostrolenk, Faber, Gerb & Soffen

[57] ABSTRACT

A dry end of a paper making machine comprising two dryer groups of dryer cylinders each followed by a respective web path reversal roll, which may be in the form of a suction guide roll, and a respective porous web support belt that meanders past each dryer cylinder and the next web path reversal roll for each dryer group. The last one of the first dryer group reversal rolls and the first one of the second dryer group reversal rolls, and additional guide rolls for guiding both the first and the second support belts, being so placed that at the place where the web is transferred from the first support belt to the second support belt, there is a spaced distance between the first and the second support belts. A web separation device generally inside the loop of the first support belt and opposite the first one of the second reversal rolls directs air through the first support belt to help transfer the web from the first support belt to the second support belt at the first one of the second reversal rolls. The web transfer device may be an additional blast zone on the circumference of the last one of the first reversal rolls, or an additional guide roll for the first support belt positioned to deflect the air, or another deflecting device positioned to deflect the air.

24 Claims, 3 Drawing Sheets 7
8
9
10
19a
11
12
13
14
15
16
17
19
20
21
21'
22
23
24
24a
25
26
27
29
32
33
4a
4b
a
A
C
IV 10
24
4a
4b
4c
4d
4e
4f
4g
4h a
24a
9
D
28
27
26
25
18
17
16
15
20
5
40
6
3
24
14
19
23
13
22
12
21'
21
11
10
19a
9
8
7

DRYER GROUP WEB TRANSFER REGION FOR PAPER MAKING MACHINE WITH OPEN DRAW

BACKGROUND OF THE INVENTION

The present invention relates to a dry end of a paper making machine. This is an improvement upon and a modification of the dry end shown in an application filed on the same date as this one based on German Application G 91 00 762.3, filed Jan. 24, 1991.

The dry end consists of a plurality of dryer groups. Each comprises at least one and typically a plurality of dryer cylinders. The dryer cylinders in each group alternate with belt reversal rolls. A respective support belt for a web passes through each dryer group and meanders alternately to partially wrap each dryer cylinder and the following reversal roll. The invention is particularly concerned with the arrangement of reversal rolls at the transfer regions between adjacent dryer groups where the web is transferred from the support belt of a preceding dryer group to the support belt of a succeeding group. Features of such a dry end are known from Federal Republic of Germany Utility Model 90 01 209.7, which corresponds to U.S. application Ser. No. 07/467,788, filed Jan. 19, 1990. The dry end dries a fiber web, for instance, a web of paper, particularly in a paper making machine, which is designed for a very high operating speed. The highest operating speed can be about 1500 m/min, or even more. In order to achieve this, the support belts for the web are preferably porous dryer wires and the reversing rolls are preferably suction guide rolls which hold the web against the outside of the support belt in each dryer group as the web passes around the reversing rolls, so long as the support belt and the web travel together from one dryer cylinder to the next one in sequence.

In the above mentioned Utility Model, the web is transferred from a first dryer group comprised of a first group of dryer cylinders to a second dryer group comprised of a second group of dryer cylinders. A first suction guide roll of the second dryer group serves as a removal roll. The first support belt of the first dryer group travels around a final suction guide roll and then travels tangentially to the circumference of the removal roll, around which the second support belt of the second dryer group also travels. In front or upstream of the removal roll in the direction of travel, the first and second support belts form a so called angle of convergence, which may amount to between about 2° and 30°. This configuration is more favorable than another known arrangements also using a removal roll in which the two support belts travel a distance parallel to each other in front of the removal roll, where the web is located between the two support belts. With this parallel guidance, there is the danger that the web, which is still moist, may be subjected to injurious stressing, particularly if the two belts travel at a certain speed differential.

According to the above mentioned Utility Model, the support belt of the second dryer group comes into contact over a small portion of the circumference of the removal roll with the support belt of the first dryer group. This means that the support belt of the first dryer group wraps around the circumference of the removal roll over a small angular sector. In addition, it is proposed that this angle of wrap be variable during the operation of the machine. In this way, it is possible to transfer the web with a high degree of safety, i.e. without a substantial danger of it tearing, from the first support belt of the one dryer group to the second support belt of the next dryer group. This is true even for very high operating speeds, because impermissible stressing of the web can be avoided. If necessary, the angle of wrap may even be zero.

Finally, the above mentioned Utility Model takes into account that at times one dryer group must be shut down while the others continue to operate. For this event, provision is made temporarily to establish a distance at the suction pickup roll of the second dryer group between the support belts of the first and second dryer groups.

Although the dry end of a paper making machine described above has proven satisfactory in practice, further improvements are desirable. There is a disadvantage of the known dry end. The paper web tears during normal operation of the drying section. This can never be completely avoided. The torn web is not present between the two support belts of two adjacent dryer groups. As a result, the two support belts travel temporarily in direct contact with each other over the suction pickup roll, which is usually the first roll of the following dryer group. Although the joint path of travel of the two support belts here is only short and although this operating condition generally lasts only for a brief time, the temporary mutual contact of the two support belts, which, as mentioned above, are developed as dryer wires, appears to cause a certain amount of wear on the outsides of the support belts.

SUMMARY OF THE INVENTION

The object of the present invention is therefore to improve the above described known dry ends of paper making machines so that the previously observed wear of the support belts is reduced as much as possible. The present invention is based primarily on the discovery that direct contact between the two support belts can always be avoided at the place where the paper web transfers from one support belt to the other support belt between two successive dryer groups and that the web nevertheless transfers over the resulting open draw with high dependability, i.e. without substantial danger of tearing, from the one dryer group to the next dryer group. For this purpose, a free short path of travel or open draw is provided for the web, which differs from the previously mentioned dry ends.

According to the invention, under all operating conditions, there is always a distance between the two support belts of the successive dryer groups. These conditions include normal operation with a regularly travelling paper web and include the temporary phases without a paper web on the support belts, which may occur, for instance, during placing the dry end in operation or after the paper web tears. Therefore, there never will be any contact between the two support belts, which eliminates a previous cause of support belt wear.

An additional advantage is obtained. Although the free path of travel or open draw of the paper web is only very short, the free path of travel is still sufficient to permit a reduction of stresses which can arise in the paper web upon its travel through the first dryer group. Since a precisely definable small difference in speed between the two support belts can be set by means of their ordinary drive control device, any longitudinal stressing which may occur in the paper web can be properly controlled and possibly reduced. Furthermore, transverse stressing, which might possibly occur in the paper web, can also be reduced by the construction in accordance with the present invention.

The transfer of the web of paper from the first support belt to the second support belt is effected, as previously, in the region of the first web reversal roll, which may be in the form of a first suction guide roll, of the second dryer group. That first web reversal roll of the second dryer group need not be a suction roll, however. Because there is always a distance between the two support belts, this first suction guide roll of the second dryer group no longer has the previous function of serving as a suction pickup roll. It can no longer actively pick up or remove the paper web from the first support belt.

According to the invention, a web separation device is instead provided within the loop of the first support belt. That device forces air through the first support belt to separate the moving web from the first support belt and to deflect it in the direction toward the second support belt. The web is drawn onto the second belt by the vacuum generated by the first suction guide roll of the second dryer group and the web is thereafter guided as previously through the second dryer group. Even without suction in the first web reversal roll, the web will be guided onto that roll. It is forced off the first support belt by the web separation device.

The web separation device can be integrated into the last suction guide roll of the first dryer group, and can be in the form of a blast zone of that roll. This blast zone is preferably arranged in that part of the circumference of the last suction guide roll at which the support belt travels off that roll. As a rule, in this case, a relatively small distance is provided between the last web reversal roll or suction guide roll of the first dryer group and the first suction guide roll of the second dryer group in the direction of travel of the web. The paper web will therefore travel onto the second support belt either on that circumferential part of the first suction guide roll at which the second support belt wraps around the first suction guide roll or at a certain distance in front of or upstream of that part of the circumference of that first suction guide roll. This arrangement is particularly suitable for those paper making machines in which the reduction of stresses in the paper web plays a less important role.

There may be another advantageous embodiment of the web separation device. At a certain distance after or downstream of the last suction guide roll of the first dryer group along the path of the first support belt, an air boundary layer deflection device is provided on the inner side of the endless loop first support belt. This device forces the air boundary layer, which has advanced along with the inner side of the support belt, through the porous first support belt in order for that air flow to separate the paper web from the first support belt. In this case, therefore, a relatively large distance is to be provided in the direction of travel of the web between the last web reversal roll or suction guide roll of the first dryer group and the first web reversal roll or suction guide roll of the second dryer group. In this way, a relatively long straight path of free travel is present for the first support belt and for the web of paper carried by that belt between the last suction guide roll of the first group and the web separation device. This straight path of travel is required, on the one hand, in order for a sufficient air boundary layer to form. On the other hand, this free path of travel can additionally be used for reducing stresses in the web of paper. The web of paper is guided by the first support belt on this free path of travel. But, it no longer adheres as firmly to that support belt as it does for instance, in the circumferential region of the last suction guide roll of the first dryer group roll. Thus, the web of paper is given an opportunity, also already in this straight path of travel, to shrink to a slight extent so that stresses are avoided. This reduction is in addition to the reduction in the stress which takes place, as mentioned above, in the following free path of travel or open draw of the paper web.

Other objects and features of the invention are described in the following description of the embodiments shown in the accompanying drawings.

BRIEF DESCRIPTION OF THE DRAWINGS

Each of FIGS. 1 to 3 shows diagrammatically a side view of a dry end embodiment, which is part of a paper manufacturing machine.

DESCRIPTION OF THE PREFERRED EMBODIMENTS

Figure 1:
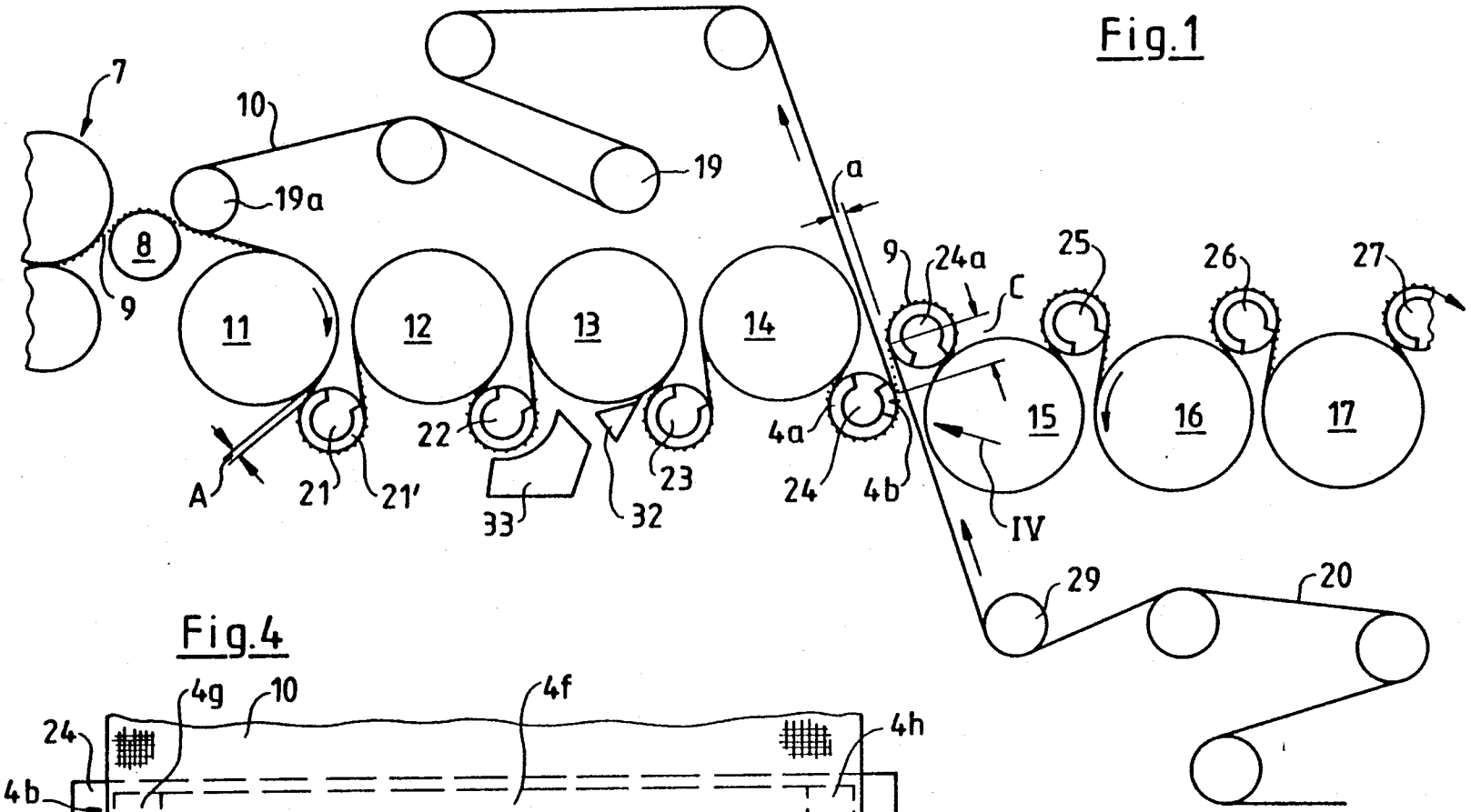
Figure 2:
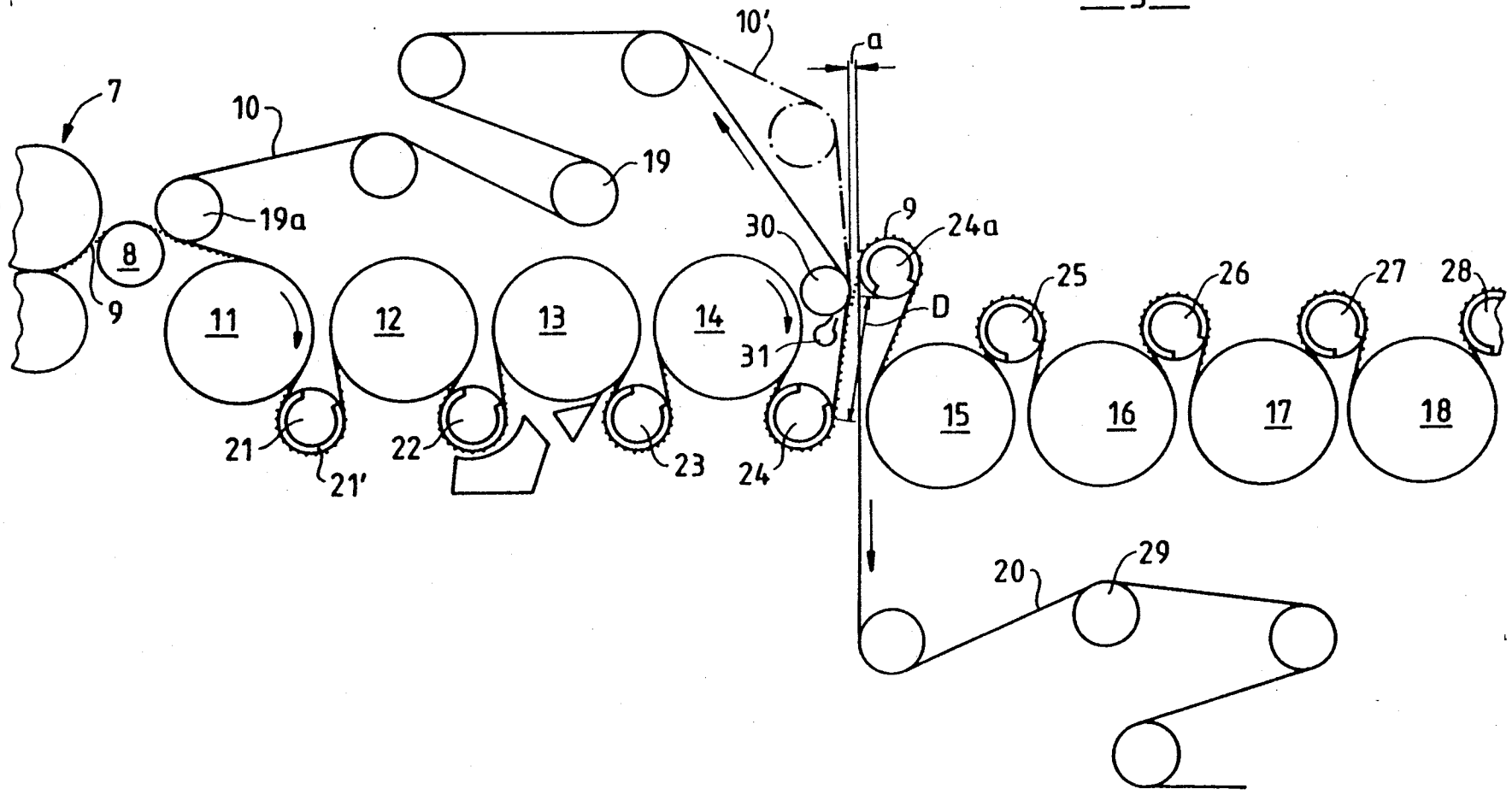
Figure 3:
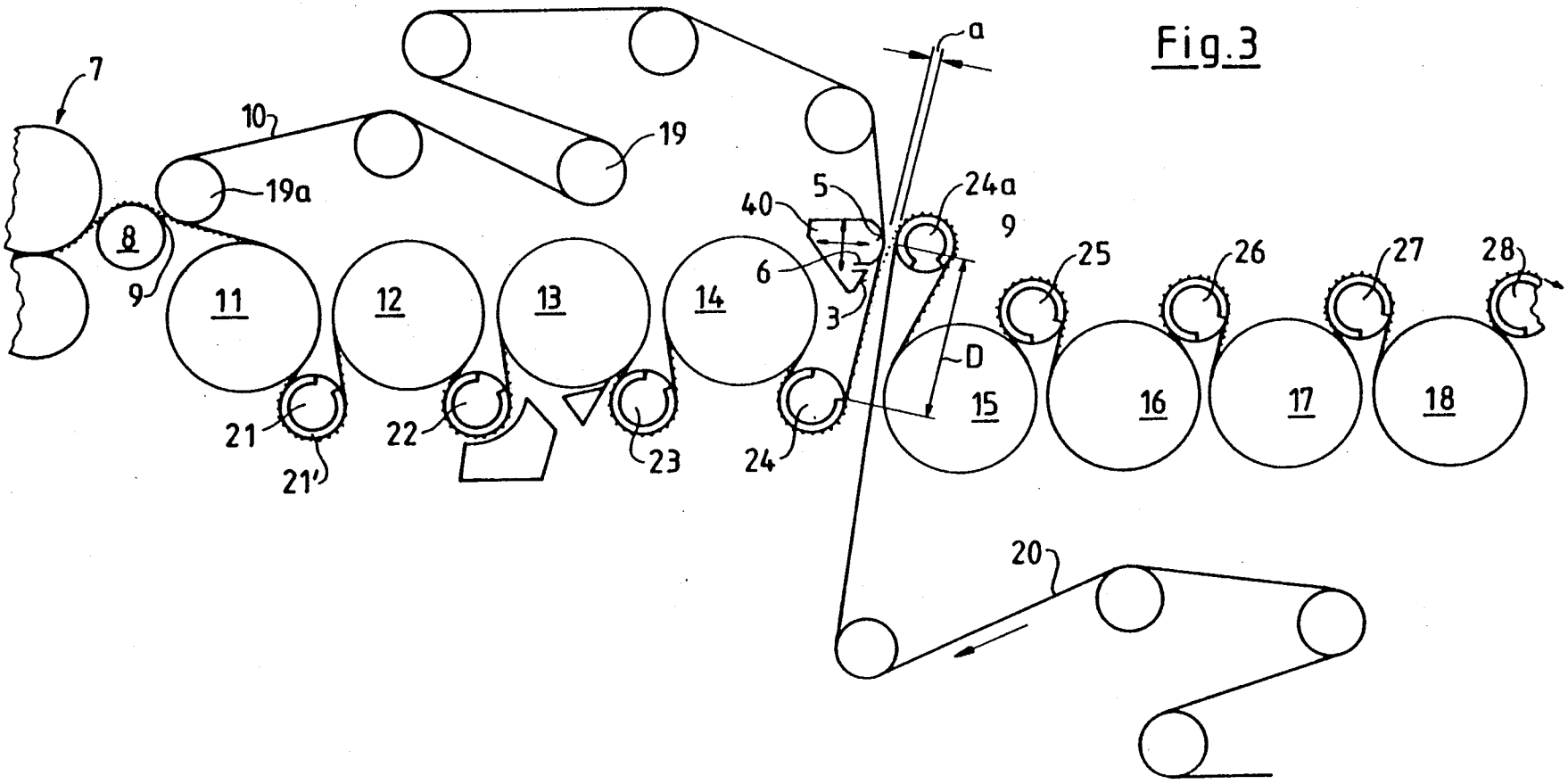

In FIGS. 1 to 3, the paper Web 9 to be dried is indicated partly as a dotted line. The web travels from left to right through the dry end. A first dryer group comprises, for instance, four heatable dryer cylinders 11 to 14 whose top sides heat the web and four bottom, web path direction reversal rolls which are illustrated in the form of suction guide rolls 21 to 24, over whose bottom sides the first support belt 10 passes. A paper guide roll 8 transfers the web of paper 9 from the end of a press section 7 onto a first endless loop, porous web support belt 10, which is preferably developed as a dryer wire. The first support belt 10 travels first over a guide roll 19*a* which can, if deemed necessary, be developed as a suction roll. The web of paper 9 travels in a meander path together with the first support belt 10 through the first dryer group, i.e. it travels alternately over one of the top of the dryer cylinders 11 to 14 and then over the bottom of the next adjacent one of the suction guide rolls 21 to 24. From the last suction guide roll 24, the support belt 10 travels over several normal belt guide rolls 19 back to the first belt guide roll 19*a*.

At the point of departure from each dryer cylinder 11 to 14, there is a very short distance A of between 30 and 100 mm between the circumference of the dryer cylinder and the circumference of the respective adjacent suction guide roll 21 to 24. This assures that the web does not remain stuck to the surface of the cylinder but instead directly follows the support belt 10. The suction zone extends into the unwrapped region at the place where the support belt 10 comes onto the suction guide roll. In this way, the air boundary layer transported by the support belt can be drawn off. The suction zone 21' is preferably formed by a stationary suction box which is arranged within the suction guide roll. As an alternative, box-less suction rolls can also be used which do not have a defined suction zone. In other words, the entire circumference of the roll is uniformly acted on by suction. An asymmetric arrangement of the suction guide rolls between the neighboring cylinders is shown, i.e. the suction guide rolls are closer to the preceding cylinders and further from the following ones. But, a symmetrical arrangement is also possible.

The second dryer group comprises several bottom dryer cylinders 15 to 17, whose bottom sides contact the web, and several top, web direction reversal rolls in the form of suction guide rolls, e.g. 24*a* and 25 to 27, whose top sides contact the second endless loop, porous web support belt 20. The entire second dryer group is not completely shown. The second support belt extends from the last suction guide roll over a plurality of normal belt guide rolls 29, back to the first suction guide roll 24*a* of the second dryer group. In the region of that first suction guide roll 24*a*, the paper web 9 transfers from the first support belt 10 to the second support belt 20.

Although the first web reversal roll 24*a* in the second dryer group is herein described as a suction guide roll, it need not be a suction roll. Instead the below described web separation devices 31, 6 or even 4*b* will blow the web off the final support belt to the second support belt 20 without need for the roll 24*a* to have suction for the web.

In the first dryer group, a "first side", in that example, the bottom side of the paper web 9 comes into contact with the top sides of the first dryer cylinders 11 to 14. In the second dryer group, on the other hand, the "second side" in the example, the bottom side of the paper web 9 comes into contact with the dryer cylinders 15 to 17 in FIG. 1, or 15 to 18 in the embodiments of FIGS. 2 and 3. Differing from the embodiments shown in all of the drawings, at least one additional dryer group with top dryer cylinders and bottom suction guide rolls can furthermore be provided between the exit end of the press section 7 and the first dryer group of cylinders 11 to 14. At least one additional dryer group and/or a calendar or a sizing press can be present after the second dryer group.

Scrapers 32 can be arranged on the dryer cylinders 11 to 17 after the point where the first support belt leaves each cylinder. Air blast boxes 33 can be arranged in the region of each of the suction guide rolls 21 to 27, as indicated merely at roll 22 in FIG. 1.

In all embodiments, there is a distance a continuously present between the two support belts 10 and 20 at the place where the paper web 9 transfers from the first support belt 10 onto the second support belt 20. This distance a between the belts can, for instance, amount to between 30 and 100 mm. A short free travel path or open draw of the paper web 9 is created. Here, any stresses present in the paper web can be reduced. This serves, on the one hand, to improve the quality of the finished paper and, on the other hand, to reduce the danger of the web tearing upon travel of the web of paper through the following dryer group and then through the further sections of the paper manufacturing machine. It is furthermore essential in this invention that the two support belts 10 and 20 not contact each other anywhere. This reduces the wearing of and thus increases the lives of the support belts.

The presence of the two rolls, the last suction guide roll 24 of the first dryer group and the first suction guide roll 24*a* of the second dryer group, where the web is transferred from the first support belt 10 to the second support belt 20, ensures that the angle of wrap around the two adjacent drying cylinders 14 and 15 essentially equals that of the wrap around most of the other drying cylinders 12, 13, 16, 17, etc. It also ensures that the drying cylinders 14 and 15 will transfer more heat to the web being dried. This is in contrast to another system, not shown, wherein the web travels straight and direct from cylinder 14 to cylinder 15.

Figure 4:
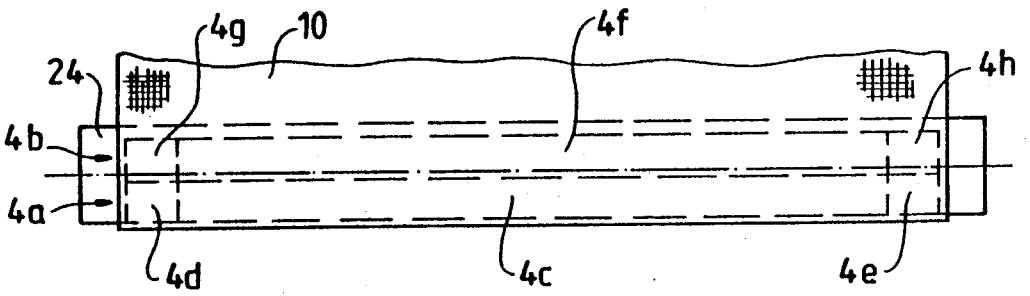
FIG. 4 is a partial view, seen in the direction of the arrow IV of FIG. 1.

The last suction guide roll 24 of the first dryer group has, as shown in FIG. 1, a somewhat shorter circumferential length suction zone 4*a* and, in the region of removal of the support belt 10, it has a blast zone 4*b*. The zone 4*b* serves as a web separating device in the manner that air is blown through the perforated roll shell and through the first support belt 10, so that the web of paper separates from the first support belt 10 and is forced onto the second support belt 20. FIG. 4 diagrammatically shows that the suction zone 4*a* can be divided into an axially central main zone 4*c* and an operator's-side edge, lateral zone 4*d*. In the latter zone, a higher vacuum level can be established than in the main zone 4*c*. The higher vacuum can be set, continuously or only temporarily, for instance, upon known threading of the web edge strip into the dry end. At the opposite end of the roll 24, there can also be an edge zone 4*e*. In a similar fashion, the load zone 4*b* can be divided into a central zone 4*c* and one edge zone or else opposite edge zones 4*g*, 4*h*. With certain types of paper, it will be possible to provide merely the edge blast zones 4*g* and 4*h* and to completely omit the central zone 4*f*.

The distance C between the place where the first support belt runs off from the last suction guide roll 24 of the first dryer group up to the place where the second support belt 20 runs onto the first suction guide roll 24*a* of the second dryer group defines an open draw, which is relatively short, for instance, on the order of magnitude of the diameter of the suction guide roll, or even less than that.

Parallel travel of the two support belts 10 and 20 along their paths between the rolls 24 and 24*a* is shown. However, this path can be deviated from parallel, if deemed necessary. For example, the two support belts can converge toward each other as in FIG. 2 or 3.

In FIG. 2, instead of providing the blast zone 4*b* in FIG. 1, at the location along the path of the web which is opposite the first suction guide roll 24*a* of the second dryer group, the first support belt 10 travels over an additional guide roll 30. The positions of the guide rolls 19 for the belt 10 and of the rolls 24 and 30 causes the belt 10 to contact the roll 30 and deflect to wrap partially around the roll 30. Between the place where the first support belt 10 travels off the last suction guide roll 24 up to the place where the support belt 10 travels onto the additional guide roll 30, there is a free travel path of the support belt 10 having a length D. The length D is selected according to a number of factors. It is a function of the operating speed of the paper manufacturing machine. Another factor in determining the length D is that a sufficient boundary air layer must form on the inside of the support belt 10 between the rolls 24 and 30. That layer must then be forced through the porous support belt 10 with the aid of the guide roll 30, in order to separate the web 9 from the first support belt 10. For this purpose, the length D should be such that the time of travel of a point on the first support belt 10 through the free travel path is at least 0.02 seconds. Another factor in setting the length D can be that the paper web should have an opportunity to reduce stresses in the paper web during travel over the free travel path. For this purpose, a travel time of about 0.05 to 0.15 seconds is necessary. The value of length D also depends on the type of paper being produced. In general, a length D of about 1 or 2 mm is sufficient. Furthermore, if stresses are to be reduced in the paper web over the free travel path of the length D, the path should be free of any suction devices which would hold the web 9 fast to the support belt 10. The angle of wrap of the support belt 10 around the additional guide roll 30 may differ, as is shown in part in solid line and, as an alternative, as is shown in part in dot dash line 10'.

During the starting of the paper machine operation and when, therefore, the operator's-side web edge strip is threaded into the dry end, it may be advantageous to reliably transfer the leading tip of the edge strip, by means of an additional blast nozzle 31, from the first support belt 10 to the second support belt 20. Such a blast nozzle can also be arranged in the region of the drive side of the paper machine.

The embodiment in FIG. 3 differs from that in FIG. 2 substantially merely by the fact that instead of there being an additional guide roll 30 as in FIG. 2, there is a stationary box 40. The box has a deflection surface 3 which is acted on by the oncoming boundary air layer traveling with the first support belt 10. In other words, the deflection surface 3 and the oncoming first support belt converge toward each other. The deflection surface 3 can have a concave curvature. Adjoining the deflection surface 3, the box 40 has a small convexly curved slide surface 5 which deflects the support belt 10 around a small angle of curve. It is the cooperation of the placement of the guide rolls 19 for the first support belt 10, of the rolls 24 and **24*a*, of the box 40 and of its surface 3 that determines the deflection of the belt 10 around the box 40 and its surface 5. The box 40 can extend over the entire width of the machine. As an alternative to this, relatively short width boxes of the type described above can be provided toward the lateral edges of the dry end merely at the two lateral edges of the web. Instead of the blast nozzle 31 in FIG. 2, an additional blast opening 6 can be provided in FIG. 3 in the deflection surface 3 of the box 40**.

In FIGS. 1 to 3, the dryer cylinders 11 to 14 of the first dryer group lie at a higher level than the dryer cylinders 15 to 17 of the second dryer group. As an alternative to this, all of the dryer cylinders can be arranged on the same height or level, particularly in the case of the embodiments of FIGS. 2 and 3. Differing from the horizontal rows of cylinders shown, vertical or inclined rows of cylinders can alternatively be provided, as shown in Federal Republic of Germany OS 40 41 493 and U.S. Ser. No. 07/672,392.

As shown in FIG. 3, the position of the box 40 is adjustable both in the direction of travel of the web and transversely thereto, as indicated by the crossed double headed arrows. In similar manner, in FIG. 2 the position of the additional guide roll 30 can be adjusted. The primary purpose of that is to find the best value of the distance a between the two support belts 10 and 20. To accomplish the same purpose, in FIG. 1, the first guide roll downstream of and above the drying cylinder 14 may be shiftable in an approximately horizontal direction. In all cases, the distance a may never be made equal to zero.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dry end of a machine for manufacturing a paper web, comprising:

a first dryer group comprised of a first plurality of heatable dryer cylinders, a respective first web reversal roll next to each of the first dryer cylinders, a first support belt passing alternately over a first dryer cylinder and then over the neighboring first reversal roll, the first dryer cylinders and the first reversal rolls being so placed that the first support belt partially wraps around each first dryer cylinder; the first support belt has a first side for supporting the paper web, the first support belt passes through the first dryer group together with the paper web so that the first side of the web comes into direct contact with the first dryer cylinders while the opposite second side of the web is in continuous contact with the first side of the first support belt;

a second dryer group following the first dryer group in the path of the paper web through the dry end, the second dryer group being comprised of a second plurality of heatable dryer cylinders, a respective second web reversal roll next to each of the second dryer cylinders, a second support belt passing alternately over a second dryer cylinder and then over the neighboring second reversal roll, the second dryer cylinders and the second reversal rolls being so placed that the second support belt partially wraps around each second dryer cylinder; the second support belt has a second side for supporting the paper web, the second support belt passes through the second dryer group together with the paper web so that the second side of the web comes into direct contact with the second dryer cylinders while the opposite first side of the web is in continuous contact with the second support belt;

there is a last one of the first reversal rolls after the last one of the first dryer cylinders in the path of the first support belt through the first dryer group; there is a first one of the second reversal rolls in front of the first one of the second dryer cylinders in the path of the second support belt through the second dryer group; the first one of the second reversal rolls being so placed that the web on the first support belt transfers from the first support belt to the second support belt in the region of the first one of the second reversal rolls;

first guide means for the first support belt, second guide means for the second support belt, the first and second guide means being so placed and the last one of the first reversal rolls and the first one of the second reversal rolls being so placed that there is always a spaced distance between the first and the second support belts and that distance between the support belts exists as those belts pass the last one of the first reversal rolls and the first one of the second reversal rolls;

a web separation means at the first support belt generally opposite the first one of the second reversal rolls and positioned at the first support belt to force air through the first support belt in the direction toward the second support belt for aiding the transfer of the web off the first support belt toward the second support belt.

2. The dry end of claim 1, wherein the first one of the second reversal rolls is a suction guide roll which applies suction to the second support belt and to the web being transferred to the second belt.

3. The dry end of claim 2, wherein the first and the second support belts are porous belts permitting air to travel therethrough.

4. The dry end of claim 3, wherein the first one of the second reversal rolls is a suction guide roll which applies suction to the second support belt and to the web being transferred to the second belt.

5. The dry end of claim 4, wherein all of the reversal rolls are suction guide rolls which apply suction to the respective one of the first and the second support belts and to the web as the respective support belt passes over the respective reversal roll.

6. The dry end of the claim 1, wherein the first and the second support belts are porous belts permitting air to travel therethrough.

7. The dry end of claim 6, wherein the web separation means is placed along the path of the first support belt toward the first of the second reversal rolls to be on the path of the first support belt before the first support belt passes opposite the first of the second reversal rolls.

8. The dry end of claim 7, wherein the web separation means comprises a blast zone located in the last of the first reversal rolls, and the blast zone being adapted to direct its blast toward the first support belt.

9. The dry end of claim 6, wherein the web separation means is arranged along the path of the first support belt as to be opposite the first of the second reversal rolls and generally in the region of that part of the circumference of the first of the second reversal rolls that is wrapped by the second support belt.

10. The dry end of claim 6, wherein the web separation means comprises a blast zone located in the last of the first reversal rolls, and the blast zone being adapted to direct its blast toward the first support belt.

11. The dry end of claim 10, wherein the blast zone is arranged in that part of the circumference of the last of the first reversal rolls at which the first support belt travels off the last of the first reversal rolls.

12. The dry end of claim 6, wherein the web separation means comprises a boundary air layer deflection device arranged on the side of the first support belt that is away from the first of the second reversal rolls, and the deflection device being oriented for forcing the boundary air layer through the first support belt.

13. The dry end of claim 12, wherein the first guide means for the first support belt are so placed and the deflection device is so placed as to define a free, unsupported travel path for the first support belt from the last of the first reversal rolls to the boundary air layer deflection device, the length of the free travel path is such that the time of travel of a point on the first support belt through the free travel path is at least 0.02 seconds.

14. The dry end of claim 13, wherein the length of the free travel path is such that the time of travel of a point on the first support belt through the free travel path is in the range of 0.05 to 0.15 seconds.

15. The dry end of claim 13, wherein the boundary air layer deflection device comprises a guide roll, and the deflection device guide roll and the first guide means for the first support belt being so placed that the deflection device guide roll is partially wrapped by the first support belt.

16. The dry end of claim 13, wherein the boundary air layer deflection device comprises a stationary box, the box having a deflection surface facing toward the first support belt and positioned to be acted upon by the oncoming boundary air layer for deflecting that boundary air layer through the first support belt.

17. The dry end of claim 16, wherein the deflection surface is concavely curved with respect to the first support belt and the boundary air layer for deflecting the air through the first support belt.

18. The dry end of claim 16, wherein the stationary box has a slide surface; the stationary box slide surface, the first support belt and the first guide means are so positioned that the slide surface engages and deflects the first support belt around the slide surface by a small angle.

19. The dry end of claim 6, wherein the dry end has edge zones at the lateral web edges; an additional air blast device provided on the web separation device directed for blowing an air blast through the first support belt in the direction toward the second support belt at at least one web edge zone.

20. The dry end of claim 6, wherein the web separation device extends over the entire width of web.

21. The dry end of claim 6, wherein the dry end has an edge zone at the operator's side edge zone of the width of the web, and the web separation device extends axially only over the operator's side edge zone of the width of the web.

22. The dry end of claim 6, wherein the dry end and the web separation device both have lateral edge zones and the web separation device extends only over both of the lateral edge zones of the width of the web and of the dry end.

23. The dry end of claim 6, wherein the first and the second guide means and the last of the first reversal rolls and the first of the second reversal rolls are so positioned that upon travel of both of the first and second support belts toward the first of the second reversal rolls, the first and the second support belts travel parallel to each other.

24. The dry end of claim 6, wherein the first and second guide means and the last of the first reversal rolls and the first of the second reversal rolls are so positioned that upon travel of both of the first and second support belts toward the first of the second reversal rolls, the first and the second support belts travel along respective paths that converge toward each other in the direction along the path of the web toward the first of the second reversal rolls.

* * * * *